US008256213B2

(12) United States Patent
Kuhlbach et al.

(10) Patent No.: US 8,256,213 B2
(45) Date of Patent: Sep. 4, 2012

(54) CYLINDER HEAD FOR AN INTERNAL COMBUSTION ENGINE

(75) Inventors: Kai Sebastian Kuhlbach, Bergisch Gladbach (DE); Guenter Bartsch, Gummersbach (DE); Jens Dunstheimer, Cologne (DE); Martin Lutz, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 304 days.

(21) Appl. No.: 12/721,677

(22) Filed: Mar. 11, 2010

(65) Prior Publication Data

US 2010/0229819 A1 Sep. 16, 2010

(30) Foreign Application Priority Data

Mar. 13, 2009 (DE) ..... 10 2009 001 542

(51) Int. Cl.
*F02F 1/42* (2006.01)

(52) U.S. Cl. ..... 60/323; 123/193.5

(58) Field of Classification Search ..... 60/323; 123/193.5

See application file for complete search history.

(56) References Cited

U.S. PATENT DOCUMENTS

| | | | | |
|---|---|---|---|---|
| 2,664,864 | A | 1/1954 | Ernest | |
| 4,537,163 | A | 8/1985 | Sakai | |
| 4,993,227 | A * | 2/1991 | Nagura et al. | 60/605.1 |
| 6,295,963 | B1 | 10/2001 | Kollock et al. | |
| 6,763,795 | B2 | 7/2004 | Takahashi | |
| 2005/0087154 | A1 | 4/2005 | Hayman et al. | |
| 2005/0115231 | A1 * | 6/2005 | Ashida et al. | 60/313 |
| 2006/0130471 | A1 * | 6/2006 | Holder et al. | 60/323 |
| 2008/0141971 | A1 | 6/2008 | Park et al. | |
| 2009/0151343 | A1 * | 6/2009 | Son et al. | 60/323 |
| 2009/0151687 | A1 * | 6/2009 | Kong et al. | 123/193.5 |
| 2010/0251704 | A1 * | 10/2010 | Asame et al. | 60/323 |

FOREIGN PATENT DOCUMENTS

EP 2123892 A * 2/2008

OTHER PUBLICATIONS

DE Office Action Dated Sep. 21, 2009.

* cited by examiner

*Primary Examiner* — M. McMahon
(74) *Attorney, Agent, or Firm* — Julie Voutyras; Brooks Kushman P.C.

(57) ABSTRACT

A cylinder head has at least three cylinders each coupled to at least one exhaust port, individual exhaust ducts coupled to each of the exhaust ports, and a combined exhaust duct coupling all individual exhaust ducts. The combined exhaust duct emerges from the cylinder head at a location displaced longitudinally from a center of the cylinder head.

11 Claims, 1 Drawing Sheet

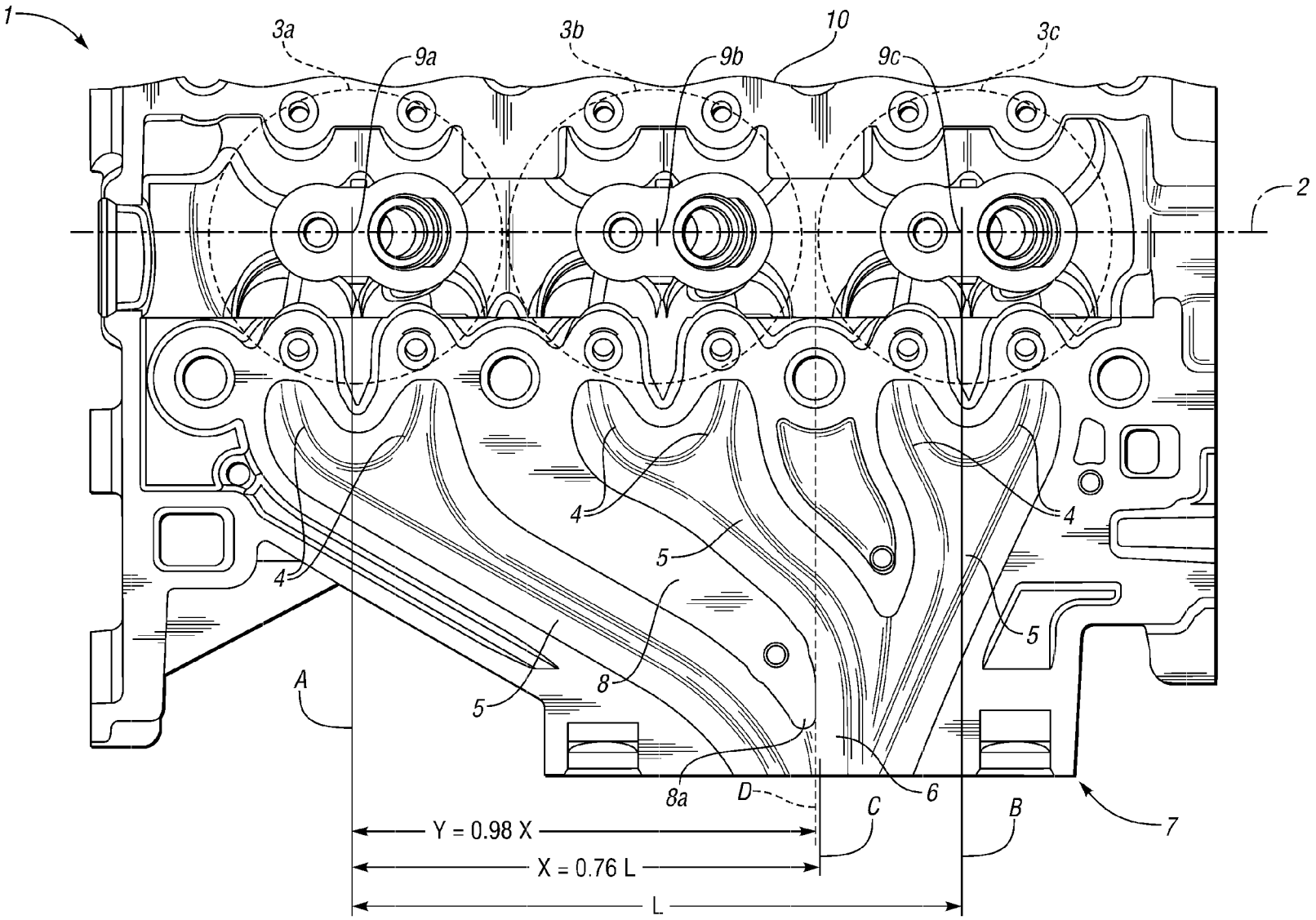
1
2
3a
3b
3c
4
5
6
7
8
8a
9a
9b
9c
10
A
B
C
D
L
X = 0.76 L
Y = 0.98 X

CYLINDER HEAD FOR AN INTERNAL COMBUSTION ENGINE

CROSS-REFERENCE TO RELATED APPLICATIONS

This application claims foreign priority benefits under 35 U.S.C. §119-(a)-(d) to DE 10 2009 001 542.6 filed Mar. 13, 2009, which is hereby incorporated by reference in its entirety.

BACKGROUND

1. Technical Field

The disclosure relates to a cylinder head for an internal combustion engine and in particular, a configuration for exhaust ports and ducts within the cylinder head.

2. Background Art

An internal combustion engine has a cylinder block and at least one cylinder head. The cylinder block has cylinder bores to accommodate pistons. The pistons are guided in the cylinders so that they can reciprocate. The cylinders and the cylinder head from the combustion chambers of the internal combustion engine.

To allow flow of fresh air into the cylinder and to expel exhaust gas out of the engine, at least one intake valve and one exhaust valve are provided for each cylinder. A valvetrain coupled to the engine is commonly used to actuate the valve opening and closing times.

In the prior art, it is common for one exhaust duct per cylinder to exit the cylinder head. The exhaust ducts are combined outside the cylinder head in an exhaust manifold. The exhaust manifold is coupled to an exhaust system, which may contain a muffler and an exhaust aftertreatment system.

SUMMARY

A cylinder head is disclosed which has at least three cylinders each having at least one exhaust port. Individual exhaust ducts are coupled to each of the exhaust ports. A combined exhaust duct couples all individual exhaust ducts. The combined exhaust duct emerges from the cylinder head at a location displaced longitudinally from a center of the cylinder head. The combined exhaust duct forms an integrated exhaust manifold in the cylinder head.

BRIEF DESCRIPTION OF THE DRAWINGS

FIG. 1 is a view of a cross section of a portion of a cylinder head with the cross section taken through the exhaust ports and ducts.

DETAILED DESCRIPTION

As those of ordinary skill in the art will understand, various features of the embodiments illustrated and described with reference to the FIGURE may be combined with other features to produce alternative embodiments that are not explicitly illustrated and described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations consistent with the present disclosure, e.g., ones in which components are arranged in a slightly different order than shown in the embodiments in the FIGURE. Those of ordinary skill in the art will recognize that the teachings of the present disclosure may be applied to other applications or implementations.

FIG. 1 shows a cylinder head 1 having three cylinders 3*a*, 3*b*, and 3*c* with the attachment of the cylinder head onto the block, which is not visible in this view, shown in dotted circles. Cylinders 3*a* and 3*c* are outside cylinders and cylinder 3*b* is an inside cylinder. In the embodiment shown in FIG. 1, a boss is shown near the center axes 9*a*, 9*b*, and 9*c*, which show two apertures. In one embodiment, those apertures are configured to receive a spark plug and a fuel injector. Also in FIG. 1 within the dotted rings are orifices adapted to receive valve stems for four poppet valves: two intake valves at the top of FIG. 1 and two exhaust valves lower in FIG. 1. The valve stems seem to exit very near the periphery of the cylinders. However, the valves are splayed out such that the head of the valves are closer together in the combustion chamber side of the head and the valve stems stick out farther, with respect to the cylinder, at the side of the head away from the valve heads. The distance between the axes of the two outer cylinders 3*a*, 3*c* is L. Reference planes, A, and B are shown in FIG. 1, with plane A passing through a center axis 9*a* of first outer cylinder 3*a* and plane B passing through a center axis 9*c* of second outer cylinder 3*c*.

In the embodiment of FIG. 1, each cylinder has two exhaust ports 4 for removing exhaust gases from the cylinder. Exhaust ports 4 combine to form an individual exhaust duct 5. Individual exhaust ducts 5 are combined to form a combined exhaust duct 6 prior to emerging from cylinder head 1. An integrated exhaust manifold 7 is formed within cylinder head 1 by combining individual exhaust ducts within cylinder head 1. In an alternative embodiment, each cylinder has one exhaust port leading to directly to an individual exhaust duct.

The combined exhaust duct 6, according to the embodiment shown in FIG. 1, emerges from the cylinder head 1 at a distance X=0.76 L from center axis 9*a* of first outer cylinder 3*a*. The distance X between combined exhaust duct 6 and first outer cylinder 3*a* corresponds to the distance between the plane C, which passes through the center of combined exhaust duct 6 and is perpendicular to the longitudinal axis 2 of cylinder head 1 and the reference plane A.

In the embodiment illustrated in FIG. 1, the individual exhaust duct 5 corresponding with outer cylinder 3*c* and the individual exhaust duct 5 corresponding with inner cylinder 3*b* combine before joining with the individual exhaust duct 5 corresponding with outer cylinder 3*a* before combining with exhaust duct 6.

A downstream tip 8*a* of a wall 8, which separates the individual exhaust duct 5 of first outer cylinder 3*a* from individual exhaust duct 5 of inner cylinder 3*b*, is located a distance Y from reference plane A. In the embodiment shown in FIG. 1, Y=0.98 X. The distance, Y, between downstream tip 8*a* and center axis 9*a* of first outer cylinder 3*a* corresponds to the distance between reference plane A and plane D, the latter being tangential to downstream tip 8*a* of wall 8 and is perpendicular to longitudinal axis 2 of cylinder head 1.

By integrating the exhaust manifold within the cylinder head, the distance which the hot exhaust gas stream travels to reach exhaust aftertreatment system can be shortened, which gives less opportunity for exhaust gases to cool down prior to entering exhaust aftertreatment devices. Also, exhaust aftertreatment devices reach their operating temperature more quickly after cold start of the internal combustion engine when the travel distance between the combustion chamber and the aftertreatment device is shortened. Furthermore, the thermal inertia of the exhaust duct between the components between the combustion chamber and the exhaust aftertreatment device is reduced by reducing the mass and length of the exhaust gas system. In some embodiments, the combined exhaust duct 6 exits closer to a rear of the engine so that the length of the exhaust gas system is reduced even further.

Integrated exhaust manifold 7 within cylinder head 1, as shown in FIG. 1, is asymmetric, with the combined exhaust duct 6 emerging from the cylinder head closer to cylinder 3*c* than cylinder 3*a*. The duct lengths for scavenging are chosen to provide a satisfactory torque characteristic taking into account the dynamic wave processes. The asymmetric arrangement of integrated exhaust manifold 7 has the effect that exhaust flows from some cylinders are deflected less than in a symmetrically constructed exhaust manifold. The exhaust ducts or individual exhaust ducts of some cylinders have a less pronounced curvature up to the point where they enter combined exhaust duct 6 than the ducts of a symmetrically-constructed exhaust manifold. As a result, duct routing in the exhaust manifold presents less flow resistance during the removal of the exhaust gases from the cylinders, which can improve the torque characteristic of the internal combustion engine.

Cylinder head 1, shown in FIG. 1, has three cylinders. However, cylinder heads with more than three cylinders are also within the scope of the present disclosure. The disclosure applies to V engines having two cylinder banks with two cylinder heads.

In one embodiment, combined exhaust duct 6 emerges from cylinder head 1 at a distance X of 0.60 L<C<0.85 L where L is the distance between the axes 9*a*, 9*c* of the two outer cylinders 3*a*, 3*c* along longitudinal axis 2. X is measured from plane A (perpendicular to longitudinal axis 2 and passing through axis 9*a* of cylinder 3*a*) to plane C (plane through the center of combined exhaust duct 6 and perpendicular to longitudinal axis 2). In the embodiment shown in FIG. 1, X=0.76 L. In yet another embodiment, 0.6 L<x<0.85 L.

In the embodiment shown in FIG. 1, downstream tip 8*a* of wall 8 is located a distance, Y, from plane A, where Y=0.98 X. Y is the distance between plane A and plane D that is tangent to downstream tip 8*a* and perpendicular to longitudinal axis 2. In some embodiments, Y falls into the range: 0.7 X<Y<1.3 X. In yet other embodiments, Y falls into the range: 0.9 X<Y<1.1 X.

While the best mode has been described in detail, those familiar with the art will recognize various alternative designs and embodiments within the scope of the following claims. Where one or more embodiments have been described as providing advantages or being preferred over other embodiments and/or over prior art in regard to one or more desired characteristics, one of ordinary skill in the art will recognize that compromises may be made among various features to achieve desired system attributes, which may depend on the specific application or implementation. These attributes include, but are not limited to: cost, strength, durability, life cycle cost, marketability, appearance, packaging, size, serviceability, weight, manufacturability, ease of assembly, etc. The embodiments described as being less desirable relative to other embodiments with respect to one or more characteristics are not outside the scope of the disclosure as claimed.

What is claimed:

1. A cylinder head, comprising:

three cylinders including at least one inner cylinder and two outermost cylinders, each cylinder comprising two exhaust ports;

individual exhaust ducts coupled to each cylinder through the exhaust ports and coupled together into a combined exhaust duct that exits the cylinder head at a point displaced longitudinally from one of the outermost cylinders at a distance 60% to 85% of the length between the two outermost cylinders as measured between the center axes of each of the outermost cylinders thus providing less pronounced curvature of the exhaust ducts closer to the combined exhaust duct.

2. A cylinder head, comprising:

at least three cylinders having individual exhaust ducts; and a combined exhaust duct coupling all individual exhaust ducts and emerging longitudinally displaced a distance X from an axis of a first outer cylinder; 0.60*L<x<0.85*L; where L is distance between center axes of first and second outer cylinders, to provide less pronounced curvature of the individual exhaust ducts closer to the combined exhaust duct.

3. The cylinder head of claim 2 wherein each cylinder has two exhaust ports and the two exhaust ports associated with a particular cylinder combine to form the individual exhaust duct associated with the particular cylinder.

4. The cylinder head of claim 2 wherein the individual exhaust duct from the second outer cylinder and the individual exhaust duct from the inner cylinder combine at a location upstream of where all individual exhaust ducts couple.

5. The cylinder head of claim 4 wherein a downstream end of a wall which separates the individual exhaust duct of the first outer cylinder and the individual exhaust duct of the inner cylinder is at a distance Y from the first outer cylinder and 0.9X<Y<1.1X.

6. The cylinder head of claim 4 wherein a downstream end of a wall which separates the individual exhaust duct of the first outer cylinder and the individual exhaust duct of the inner cylinder is at a distance Y from the first outer cylinder and 0.7X<Y<1.3X.

7. A cylinder head, comprising:

three cylinders each having an associated exhaust duct coupling a pair of exhaust ports; and a combined exhaust duct coupling the associated exhaust ducts and emerging from the cylinder head displaced longitudinally from an outer cylinder between 0.6 and 0.85 of the length between outer cylinders as measured between the center axes of each of the outermost cylinders thus providing less pronounced curvature of the exhaust ducts closer to the combined exhaust duct.

8. The cylinder head of claim 7 wherein a downstream end of a wall which separates the individual exhaust duct of the outer cylinder and the individual exhaust duct of the inner cylinder is at a distance Y from the first outer cylinder and 0.9X<Y<1.1X.

9. A cylinder head, comprising:

at least three cylinders arranged along a longitudinal axis of the cylinder head with each cylinder coupled to at least one exhaust port;

an individual exhaust duct coupled to exhaust ports associated with each cylinder; and a combined exhaust duct coupling all individual exhaust ducts wherein the combined exhaust duct emerges from the cylinder head displaced longitudinally from an outer cylinder between 0.6 and 0.85 of the length between outer cylinders as measured between the center axes of each of the outermost cylinders thus providing less pronounced curvature of the exhaust ducts closer to the combined exhaust duct.

10. The cylinder head of claim 9 wherein each cylinder has two exhaust ports and the two exhaust ports associated with a particular cylinder combine to form the individual exhaust duct associated with the particular cylinder.

11. The cylinder head of claim 9 wherein the individual exhaust duct from an outer cylinder and the individual exhaust duct from an inner cylinder combine at a location upstream of where all individual exhaust ducts couple.

* * * * *